US006638470B2

(12) United States Patent
Schweiger

(10) Patent No.: US 6,638,470 B2
(45) Date of Patent: Oct. 28, 2003

(54) FLASH-SPINNING PROCESS AND SOLUTION

(75) Inventor: Thomas A. J. Schweiger, Richmond, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 302 days.

(21) Appl. No.: 09/773,205

(22) Filed: Jan. 31, 2001

(65) Prior Publication Data

US 2002/0000686 A1 Jan. 3, 2002

Related U.S. Application Data

(60) Provisional application No. 60/182,622, filed on Feb. 15, 2000.

(51) Int. Cl.[7] ..... D01D 5/11
(52) U.S. Cl. ..... 264/469; 264/205
(58) Field of Search ..... 264/205, 466, 264/469

(56) References Cited

U.S. PATENT DOCUMENTS 3,081,519 A 3/1963 Blades et al.
5,643,525 A 7/1997 McGinty

FOREIGN PATENT DOCUMENTS

GB 1478950 A 7/1977
WO WO 9423097 A1 10/1994

*Primary Examiner*—Leo B. Tentoni

(57) ABSTRACT

A process for flash-spinning a web of plexifilamentary film-fibril strands of synthetic fiber-forming polymer and laying down the web to form a nonwoven batt material therefrom is provided. The process includes the the step of generating a spin fluid consisting essentially of synthetic fiber-forming polymer and a spin agent, wherein the spin agent is comprised of at least 80% by weight, based on the total weight of the spin agent, of hydrocarbons comprised substantially exclusively of carbon and hydrogen atoms. The hydrocarbons are comprised of at least 25% by weight of unsaturated hydrocarbons having 4–8 carbon atoms. The process further includes the steps of flash-spinning the spin fluid at a pressure that is greater than the autogenous pressure of the spin fluid into a spin cell maintained at lower pressure to form a web of plexifilamentary film-fibril strands of said synthetic fiber-forming polymer, applying an electrostatic charge to the web by passing the web through an electric corona, and laying the web onto a grounded surface to form a batt of plexifilamentary film-fibril strands that is suitable for being consolidated into a sheet.

21 Claims, 6 Drawing Sheets

FLASH-SPINNING PROCESS AND SOLUTION

FIELD OF THE INVENTION

This invention relates to polymeric plexifilamentary film-fibril strands. More particularly, the invention relates to improvements in the process for flash-spinning and laying down polymeric plexifilamentary film-fibril strands.

BACKGROUND OF THE INVENTION

In the process for making flash-spun fibers, as disclosed in U.S. Pat. No. 3,081,519 to Blades et al. (assigned to DuPont), a solution of fiber-forming polymer in a liquid spin agent that is not a solvent for the polymer below the liquid's normal boiling point, is maintained at a temperature above the normal boiling point of the liquid and at autogenous pressure or greater, and is then spun into a zone of lower temperature and substantially lower pressure to generate plexifilamentary film-fibril strands. Suitable spin agents are described and include aromatic hydrocarbons such as benzene and toluene, aliphatic hydrocarbons such as butane, pentane, hexane, heptane, octane, and their isomers and homologs; alicyclic hydrocarbons such as cyclohexane; unsaturated hydrocarbons; and halogenated hydrocarbons such as methylene chloride, carbon tetrachloride, chloroform, ethyl chloride, and methyl chloride. The Blades et al. patent does not describe formation of flash-spun sheets. As disclosed in U.S. Pat. No. 3,227,794 to Anderson et al. (assigned to DuPont), the solution flash-spinning process requires a spin agent that: (1) is a non-solvent to the polymer below the spin agent's normal boiling point; (2) forms a solution with the polymer at high pressure; (3) forms a desired two-phase dispersion with the polymer when the solution pressure is reduced slightly in a letdown chamber; and (4) flash vaporizes when released from the letdown chamber into a zone of substantially lower pressure.

The flash-spinning process normally includes a step of applying an electrostatic charge to a flattened and partially spread web of plexifilamentary film-fibril strands after the web is spun from a spin orifice and before it is laid down on a grounded moving belt to form a sheet. The electrostatic charge is applied by passing the web through a corona field created between a multi-needle ion gun and a grounded target plate. When the web passes through the corona field, it picks up charged particles migrating from the ion gun to the target plate. The electrostatic charges applied to the individual fibrils of the web cause the fibrils to repel one another, thus separating the fibrils and further "opening-up" the film-fibril web. Each charged web is then laid down, along with other webs from adjacent spin packs onto the moving belt. Because the webs are charged, they are first attracted to the grounded moving belt and once laid down, they remain pinned in place on the belt.

During the flash-spinning process, it is important that the charge density on the webs not exceed a value that leads to electrical breakdown of the gaseous atmosphere in the spin cell, which would cause arcing between the webs and belt. When arcing occurs, the webs lose their charge and the pinning forces between the webs and the belt may be reduced such that the webs do not remain pinned to the belt. When the webs are not properly pinned to the belt, the webs may be pulled and moved by the stream of gaseous spin fluid. This causes the webs to roll into bundles such that the sheet produced from the webs is not uniform and contains defects.

Commercial sheet products made from polyethylene plexifilamentary film-fibril strands were historically produced by flash-spinning a spin fluid comprised of polyethylene in a perchlorofluorocarbon (CFC) spin agent such as trichlorofluoromethane. Unfortunately, CFCs are considered to be stratospheric ozone depletion chemicals. Alternative compounds suitable for the flash-spinning process have been developed that do not cause ozone depletion or contribute to global warming.

Included among the alternate spin agents that have been investigated are saturated hydrocarbons such as n-pentane. Although saturated hydrocarbons are not ozone depleting, they have the disadvantage, as compared to CFCs, of reducing the effective electrostatic charge applied to the flash-spun web as the web passes through the electrostatic field for a given current. As a result, the webs are not as fully opened up and the resulting non-woven sheet is less uniform than a sheet formed of more fully charged webs. In addition, saturated hydrocarbon gases tend to have low breakdown strengths. When the charge density on the web exceeds the gas's ability to support it, a conductive path forms through the gas, which is seen as an arc. The arc bleeds charge off the fibrils of the web, resulting in poor lay-down on the collection belt. The low breakdown strength of a saturated hydrocarbon gas requires a reduction in the rate at which the fibers can be processed (reduced polymer flow rate to the process) compared to spin agents having higher breakdown strength such as CFC's.

U.S. Pat. No. 5,643,525 issued to McGinty et al. describes a method for improving polyolefin web charging during flash-spinning in which the electrostatic charging step is conducted in an atmosphere comprising at least one charge-improving compound. The charge improving compounds can be introduced at very low concentrations as a gas, vapor, or mist, directly into the electrostatic charging atmosphere in the spin cell. The charge-improving compounds are substances which when ionized in the corona charging zone form stable, slow moving ions. The presence of these ions creates a more stable corona, which increases the amount of charge that can be applied to the web compared to the charge that would be achieved in the absence of the charge-improving compound. Although this approach has been found to be effective in increasing the charge on the web, the charge-improving additives do not affect the overall properties of the gaseous atmosphere in the spin cell unless the charge improving compounds are used at concentrations far higher than is possible in a flash-spinning process. Thus, arcing between the webs being laid down and the belt remains a problem. It is therefore desirable to develop a non-ozone depleting spin agent for use with existing flash spinning equipment that greatly reduces or eliminates arcing between the laid down webs and the belt so as to improve the uniformity of sheet produced from the webs laid down on the grounded belt.

BRIEF SUMMARY OF THE INVENTION

The present invention is directed to a process for flash-spinning a web of plexifilamentary film-fibril strands of synthetic fiber-forming polymer and laying down the web to form a nonwoven batt material therefrom. The process includes the the step of generating a spin fluid consisting essentially of synthetic fiber-forming polymer and a spin agent, wherein the spin agent is comprised of at least 80% by weight, based on the total weight of the spin agent, of hydrocarbons comprised substantially exclusively of carbon and hydrogen atoms. The hydrocarbons are comprised of at least 25% by weight of unsaturated hydrocarbons having 4–8 carbon atoms. The process further includes the steps of flash-spinning the spin fluid at a pressure that is greater than the autogenous pressure of the spin fluid into a spin cell maintained at lower pressure to form a web of plexifilamentary film-fibril strands of said synthetic fiber-forming polymer, applying an electrostatic charge to the web by passing the web through an electric corona, and laying the web onto a grounded surface to form a batt of plexifilamentary film-fibril strands that is suitable for being consolidated into a sheet.

The spin fluid in the process of the invention is preferably comprised of between 5 and 30 weight percent, based on the total weight of the spin fluid, of a fiber-forming polymer. Preferably, the fiber forming polymer is a polyolefin such as polyethylene or polypropylene.

The unsaturated hydrocarbons in the spin agent are preferably selected from the group of alkenes having the formula $C_nH_{2n}$ and cycloalkenes having the formula $C_nH_{2n-2}$, where n equals 4, 5, 6, 7, or 8. The spin agent has an atmospheric boiling point between 15° C. and 100° C. Preferably, the unsaturated hydrocarbon is selected from the group of 1-butene, 1-pentene, 1-hexene, 1-heptene, 1-octene, and their structural isomers, or from the group of cyclobutene, cyclopentene, cyclohexene, cycloheptene, and cyclooctene. According to a more preferred embodiment of the invention, the spin agent is comprised of at least 90% by weight of unsaturated hydrocarbons selected from the group of alkenes having the formula $C_nH_{2n}$ and cycloalkenes having the formula $C_nH_{2n-2}$, where n equals 4, 5, 6, 7, or 8. More preferably, the spin agent consists essentially of unsaturated hydrocarbons selected from the group of alkenes having the formula $C_nH_{2n}$ and cycloalkenes having the formula $C_nH_{2n-2}$, where n equals 4, 5, 6, 7, or 8. Most preferably, the spin agent consists essentially of unsaturated hydrocarbons selected from the group of 1-pentene, 1-hexene, and their structural isomers. According to one preferred embodiment of the invention, the spin agent consists essentially of hydrocarbons comprised substantially exclusively of carbon and hydrogen atoms. According to an alternative embodiment of the invention, the spin agent may include at least 10% by weight of saturated hydrocarbons selected from the group of alkanes having the formula $C_nH_{2n+2}$, and cycloparaffins having the formula $C_nH_{2n}$, where n=4, 5, 6, 7, or 8.

According to the preferred process of the invention, the process for flash-spinning a web of plexifilamentary film-fibril strands of synthetic fiber-forming polyolefin and laying down the web to form a nonwoven sheet material therefrom, comprises the steps of generating a spin fluid consisting essentially of 5 to 35 weight percent, based on the total weight of the spin fluid, of synthetic fiber-forming polyolefin and a spin agent, flash-spinning the spin fluid at a pressure that is greater than the autogenous pressure of the spin fluid into a spin cell maintained at lower pressure to form a web of plexifilamentary film-fibril strands of the synthetic fiber-forming polyolefin, applying an electrostatic charge to the web by passing the web through an electric corona, laying the web onto a grounded surface to form the web into a fibrous batt, consolidating said fibrous batt to form a fibrous nonwoven sheet, and removing the fibrous nonwoven sheet from the spin cell. The spin agent is comprised of at least 90% by weight, based on the total weight of the spin agent, of hydrocarbons comprised substantially exclusively of carbon and hydrogen atoms, and the hydrocarbons are comprised of at least 25% by weight of unsaturated hydrocarbons selected from the group of alkenes having the formula $C_nH_{2n}$, and cycloalkenes having the formula $C_nH_{2n-2}$, where n equals 4, 5, 6, 7, or 8. Preferably, the grounded surface is a grounded conveyor belt, and the step of consolidating the fibrous batt includes the step of compressing the batt between the conveyor belt and a collection roll in order to form a consolidated nonwoven sheet. It is further preferred that the spin fluid be comprised of between 8 and 25 weight percent, based on the total weight of the spin fluid, of the fiber-forming polymer. The spin agent preferably consists essentially of hydrocarbons comprised substantially exclusively of carbon and hydrogen atoms. More preferably, the spin agent consists essentially of unsaturated hydrocarbons selected from the group of alkenes having the formula $C_nH_{2n}$, and cycloalkenes having the formula $C_nH_{2n-2}$, where n equals 4, 5, 6, 7, or 8.

DEFINITIONS

Figure 1:
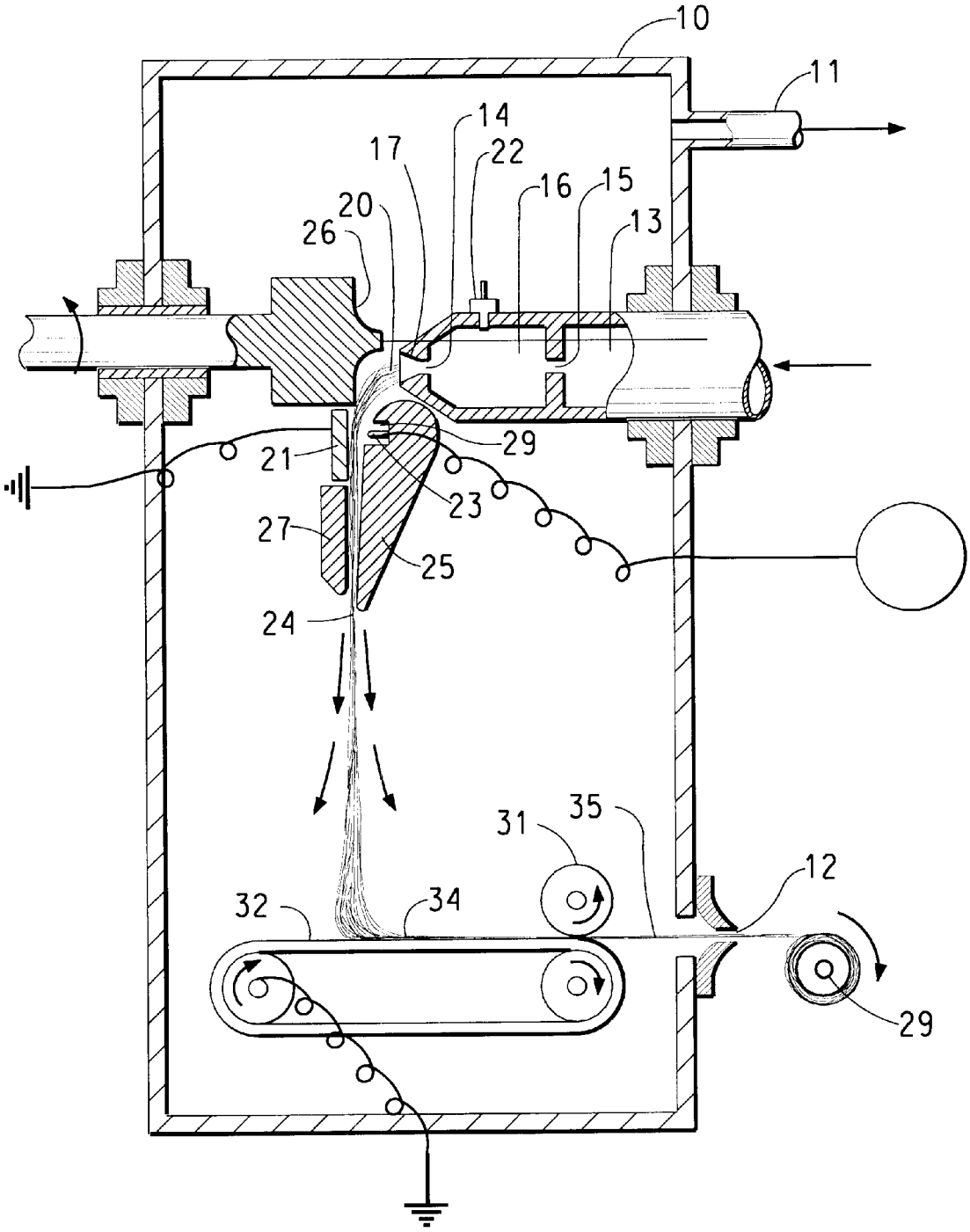
FIG. 1 (PRIOR ART)
FIG. 1 is a cross-sectional schematic representation of a flash-spinning apparatus according to the prior art.

The term "polyolefin" as used herein, is intended to mean any of a series of largely saturated polymeric hydrocarbons composed only of carbon and hydrogen. Typical polyolefins include, but are not limited to, polyethylene, polypropylene, polymethylpentene and various combinations of the monomers ethylene, propylene, and methylpentene.

The term "polyethylene" as used herein is intended to encompass not only homopolymers of ethylene, but also copolymers wherein at least 85% of the recurring units are ethylene units such as copolymers of ethylene and alpha-olephins. Preferred polyethylenes include low density polyethylene, linear low density polyethylene, and linear high density polyethylene. A preferred linear high density polyethylene has an upper limit melting range of about 130° C. to 140° C., a density in the range of about 0.941 to 0.980 gram per cubic centimeter, and a melt index (as defined by ASTM D-1238-57T Condition E) of between 0.1 and 100, and preferably less than 4.

The term "polypropylene" as used herein is intended to embrace not only homopolymers of propylene but also copolymers where at least 85% of the recurring units are propylene units. Preferred polypropylene polymers include isotactic polypropylene and syndiotactic polypropylene.

The term "plexifilamentary" as used herein, means a three-dimensional integral network of a multitude of thin, ribbon-like, film-fibril elements of random length and with a mean film thickness of less than about 4 microns and a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

The term "cloud-point pressure" as used herein, means the pressure at which a single phase liquid polymer solution starts to phase separate into a polymer-rich/spin agent-rich two-phase liquid/liquid dispersion.

The term "spin fluid" as used herein means the solution comprising the polyolefin, the primary spin agent and any co-spin agent or additives that may be present.

Test Methods

Sheet uniformity is defined as an index (uniformity index, U.I.) which is the product of the basis weight coefficient of variation times the square root of the basis weight in units of ounces per square yard. After a fibrous sheet is formed which comprises overlying webs, one of the webs is separated from the other webs in the fibrous sheet without disturbing its laydown pattern. This can be done by laying the sheet on a substrate such as a Mylar® polyester film and peeling away the overlying webs from one or both sides until the desired web is isolated. The isolated web is then scanned about every 0.4 inches in the cross direction and the machine direction by a commercially available radioactive beta gauge. The sheet thickness data for one web is used as a base to computationally create an entire sheet. One of these webs is numerically deposited on a collection belt. Another web is moved in the cross and machine directions and added to it just as it would be in the actual sheet formation. This process is repeated until the complete sheet has been formed. Alternately, six overlaid webs are similarly scanned while in sheet form and the sheet thickness data for the fibrous structure is used as a base to computationally create an entire sheet in an analogous manner. Similarly, any number of overlaid webs may be scanned without isolating individual webs. A total sheet basis weight is then determined, which has been validated by actual sheet basis weight measurements. This numerical sheet is then statistically analyzed to determine its uniformity index. The validity of this method of defining sheet uniformity quality has been verified over many years of commercial use.

The apparatus and procedure for determining the cloud point pressures of a polymer/spin agent combination are those described in U.S. Pat. No. 5,147,586 to Shin et al.

DETAILED DESCRIPTION OF THE INVENTION

Reference will now be made in detail to the presently preferred embodiments of the invention, examples of which are illustrated below. The present invention relates to a process for forming flash-spun sheets by flash-spinning a spin fluid comprising a fiber-forming polymer and an unsaturated hydrocarbon spin agent to form a plexifilamentary web, spreading and applying an electrostatic charge to the web, and laying down the charged web to form a fibrous batt. Hydrocarbon spin fluids comprising one or more unsaturated hydrocarbons reduce arcing during this flash-spinning and lay-down process as compared to spin fluids wherein the spin agent consists entirely of one or more saturated hydrocarbons. The unsaturated hydrocarbon-containing spin fluids can be flash-spun to form sheets having improved uniformity at higher polymer throughputs compared to the uniformities that are achieved with saturated hydrocarbon spin agents at similar throughputs.

The general flash-spinning apparatus chosen for illustration of the present invention is similar to that disclosed in U.S. Pat. No. 3,860,369 to Brethauer et al., which is hereby incorporated by reference. A system and process for flash-spinning a fiber-forming polymer is fully described in U.S. Pat. No. 3,860,369, and is shown in FIG. 1. The flash-spinning process is normally conducted in a chamber 10, referred to as a spin cell, which has a spin agent removal port 11 and an opening 12 through which non-woven sheet material produced in the process is removed. A spin fluid, comprising a mixture of polymer, spin agent, and any additives, is provided through a pressurized supply conduit 13 to a spinning orifice 14. The spin fluid passes from supply conduit 13 to a chamber 16 through a chamber opening 15. In certain spinning applications, chamber 16 may act as a pressure letdown chamber wherein a reduction in pressure causes phase separation of the spin fluid, as is disclosed in U.S. Pat. No. 3,227,794 to Anderson et al. A pressure sensor 22 may be provided for monitoring the pressure in the chamber 16.

The spin fluid in chamber 16 next passes through spin orifice 14. It is believed that passage of the pressurized polymer and spin agent from the chamber 16 into the spin orifice generates an extensional flow near the approach of the orifice that helps to orient the polymer. When polymer and spin agent discharge from the orifice, the spin agent rapidly expands as a gas and leaves behind fibrillated plexifilamentary film-fibrils. The gas exits the chamber 10 through the port 11. Preferably, the gaseous spin agent is condensed for reuse in the spin fluid.

A polymer strand 20 is discharged from the spin orifice 14 and is conventionally directed against a rotating deflector baffle 26 where it is flattened and turned down toward a conveyor belt 32. The rotating baffle 26 spreads the strand 20 into a more planar plexifilamentary fibrous web structure 24 that the baffle alternately directs to the left and right so as to lay the web out across the conveyor belt 32 and form a batt that can be pressed to form a nonwoven sheet. As the spread plexifilamentary structure descends from the baffle, the web 24 is electrostatically charged so as to hold the plexifilamentary structure in a spread open configuration until it reaches a moving belt 32.

The path of the oscillating web 24 passes between two spaced apart aerodynamic shields (diffusers) 25 and 27. First shield 25 includes a recess 29 along an arc at its upper portion which recess houses a plurality of needles 23 mounted in the recess. A conductive target plate 21 is positioned across the path of the web 24 from the needles 23. The needles 23 are arranged to extend toward the target plate 21 such that the distal ends of the needles 23 do not quite project out from the recess 29. An example of an electrostatic charging assembly in a flash-spinning process is more fully described in U.S. Pat. Nos. 5,558,830 and 5,750,152, which are hereby incorporated by reference.

In operation, the needles 23 are provided with a suitable DC charge and the target plate 21 is grounded so that charged particles, i.e. electrons, ions or molecules, are formed on the tips of the needles 23 and move toward the target plate 21. The area of concentration of charged particles moving to the target plate forms a corona field. As the charged particles move toward the target plate 21 some of the particles are collected onto the web 24 and carried therewith to the belt 32.

The resulting charge on the web 24 helps to maintain the plexifilaments in an open, spaced apart arrangement and also helps to pin the web down to the belt 32. The belt is grounded to help insure proper pinning of the charged plexifilamentary web 24 on the belt. The web 24 from each spin pack is laid down on the belt along with the webs from adjacent spin packs to form a fibrous batt 34 on the belt 32. The fibrous batt 34 may be passed under a roller 31 that consolidates the batt into a sheet 35 formed with plexifilamentary film-fibril networks oriented in an overlapping multi-directional configuration. The sheet 35 exits the spin chamber 10 through the outlet 12 before being collected on a sheet collection roll 29.

The spin agent of the current invention is comprised of at least 80% by weight (based on the total weight of the spin agent) of hydrocarbons comprised substantially exclusively of carbon and hydrogen atoms, wherein the hydrocarbons are comprised of at least 25% by weight (based on the total weight of the spin agent) of unsaturated hydrocarbons having 4 to 8 carbon atoms. Preferably, the spin agents of the current invention are comprised of at least 25% by weight (based on the total weight of the spin agent) of an unsaturated hydrocarbon such as an open chain olefin (alkene) having the formula $C_nH_{2n}$ or the corresponding cycloalkenes having the formula $C_nH_{2n-2}$, where n=4–8, and preferably 5 or 6. Alpha-olefins are preferred due to lower cost and higher availability compared to other isomers, however other structural isomers can also be used. Unsaturated hydrocarbons having two double bonds, such as isoprene, are expected to increase the breakdown strength of the gaseous spin agent more than unsaturated hydrocarbons containing a single double bond, however they are less stable at the high temperatures used for flash-spinning and therefore are less preferred. The spin agent can comprise 100% unsaturated hydrocarbon. The spin agents optionally contain a saturated hydrocarbon such as a paraffin compound (alkane) having the formula $C_nH_{2n+2}$, or the corresponding cycloparaffins having the formula $C_nH_{2n}$, where n=4–8, and preferably 5 or 6.

Examples of suitable alkenes useful as spin agents in the process of the current invention include 1-butene, 1-pentene, 1-hexene, 1-heptene, 1-octene, their structural isomers, and the corresponding cycloalkenes. When flash-spinning polyethylene, preferred unsaturated hydrocarbons are 1-pentene and 1-hexene. Examples of acyclic and cyclic saturated hydrocarbons which can optionally be mixed with the unsaturated hydrocarbons in the flash-spinning process of the current invention include isobutane, butane, cyclobutane, 2-methyl butane, 2,2-dimethyl propane, pentane, methyl cyclobutane, cyclopentane, 2,2-dimethylbutane, 2,3-dimethylbutane, 2-methylpentane, 3-methylpentane, hexane, methyl cyclopentane, cyclohexane, 2-methyl hexane, 3-methyl hexane, heptane, mixtures thereof, and other corresponding structural isomers. The preferred saturated hydrocarbon spin agents for flash-spinning polyethylene are n-pentane and cyclopentane.

In the process of the invention, up to 20% by weight of the spin agent may be comprised of compounds useful as flash-spinning agents other than hydrocarbons comprised substantially exclusively of carbon and hydrogen atoms. Such other compounds include halogenated hydrocarbons such as methylene chloride, carbon tetrachloride, chloroform, ethyl chloride, methyl chloride, and dichloroethylene.

Fiber forming synthetic polymers that can be flash-spun from the spin agents described above include polyolefins such as polyethylene, polypropylene, poly(4-methyl pentene-1), and their copolymers, and blends thereof.

In the process of the invention, the spin fluid may also include additives designed to impart special properties to the sheet product. Such additives may include, waxes, dyes, pigments, antioxidants, delustrants, antistatic agents, fillers, reinforcing particles, adhesion promoters, bactericidal agents, dye promoters, removable particles, ion exchange materials, ultraviolet light stabilizers, thermal stabilizers, and other additives customarily employed in the textile, paper and plastics industries.

Preferably, the spin agent is selected to yield a spin fluid having a cloud point pressure between about 800 and 2000 psig at the flash-spinning temperature. One consideration in selecting a spin agent is that the spin cell environment is preferably maintained under conditions which prevent condensation of the spin agent during flash-spinning. Thus, a C8 unsaturated hydrocarbon spin agent such as 1-octene will require a higher spin cell temperature than a C5 unsaturated hydrocarbon spin agent such as 1-pentene, for example. Preferably, the spin agent also does not have a boiling point that is so low as to make solvent recovery difficult.

Figure 3:
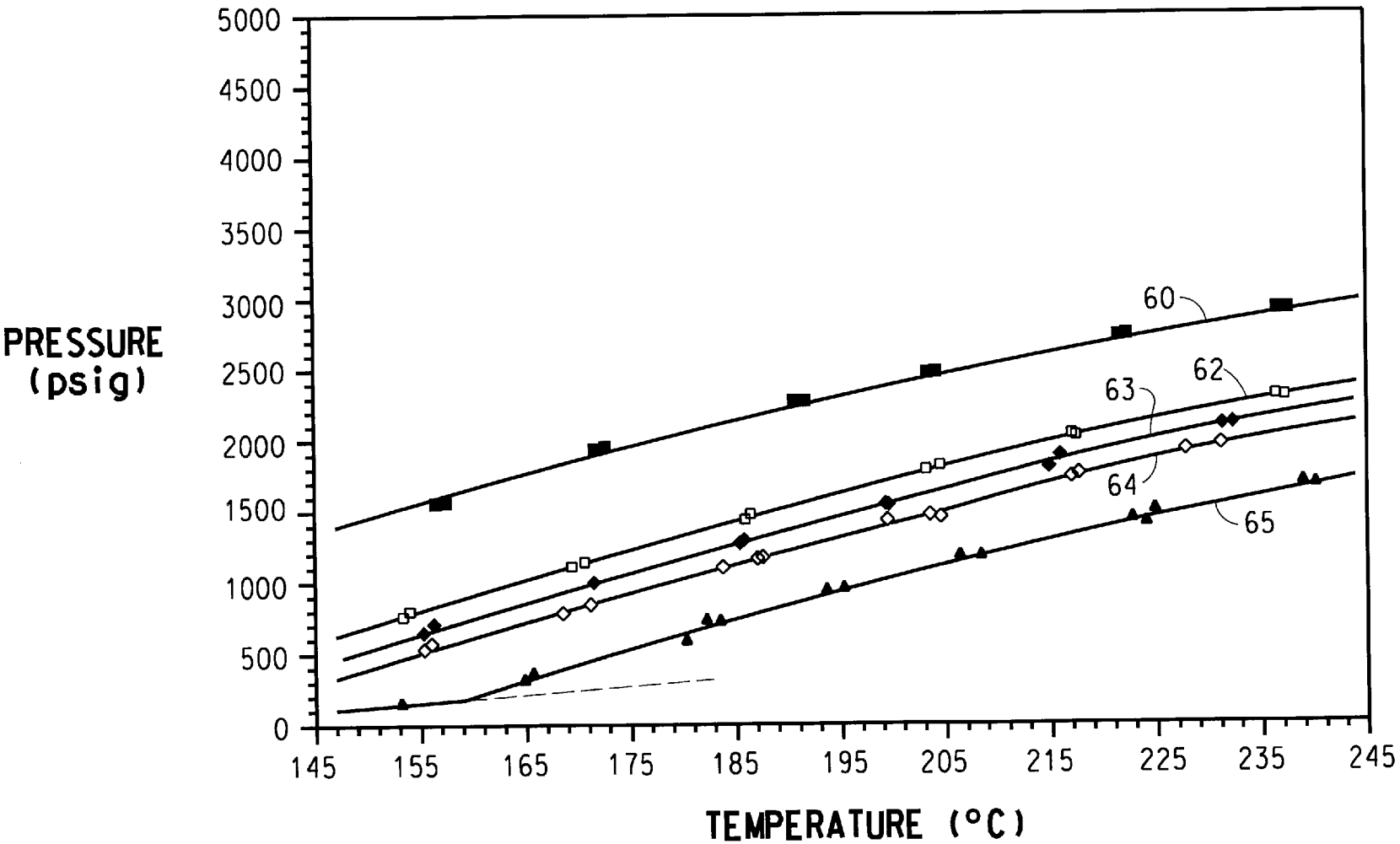
FIG. 3 is a plot of cloud point data for an 18% by weight solution of high density polyethylene in a spin agent comprised of 100% 1-pentene, 100% 1-hexene, and 3 mixtures of 1-hexene and 1-pentene.

FIG. 3 is a plot of the cloud point data for an 18% by weight solution of high density polyethylene solution in a spin agent comprised of 100% 1-pentene (curve 60), 100% 1-hexene (curve 65), and 3 mixtures of 1-hexene and 1-pentene at different solvent weight ratios (50/50, curve 62; 60/40, curve 63; 70/30, curve 64).

Figure 4:
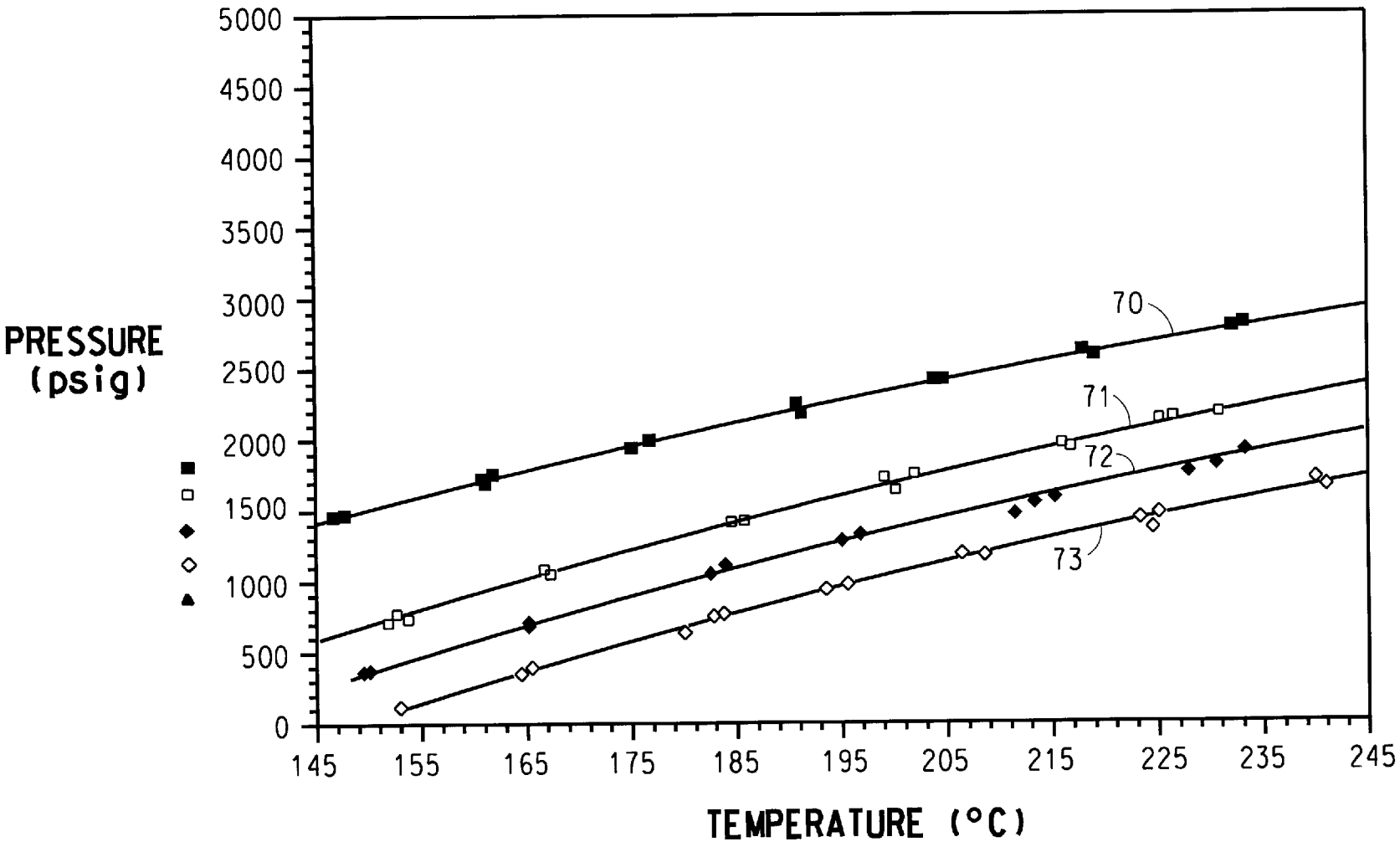
FIG. 4 is a plot of cloud point data for an 18% by weight solution of high density polyethylene in 100% n-pentane, 100% 1-hexene, and 2 mixtures of n-pentane and 1-hexene.

FIG. 4 is a plot of the cloud point data for a 18% by weight solution of high density polyethylene solution in a spin agent comprised of 100% n-pentene (curve 70), 100% 1-hexene (curve 73), and 2 mixtures of n-pentane and 1-hexene at different solvent weight ratios (50/50, curve 71; 30/70, curve 72).

Figure 5:
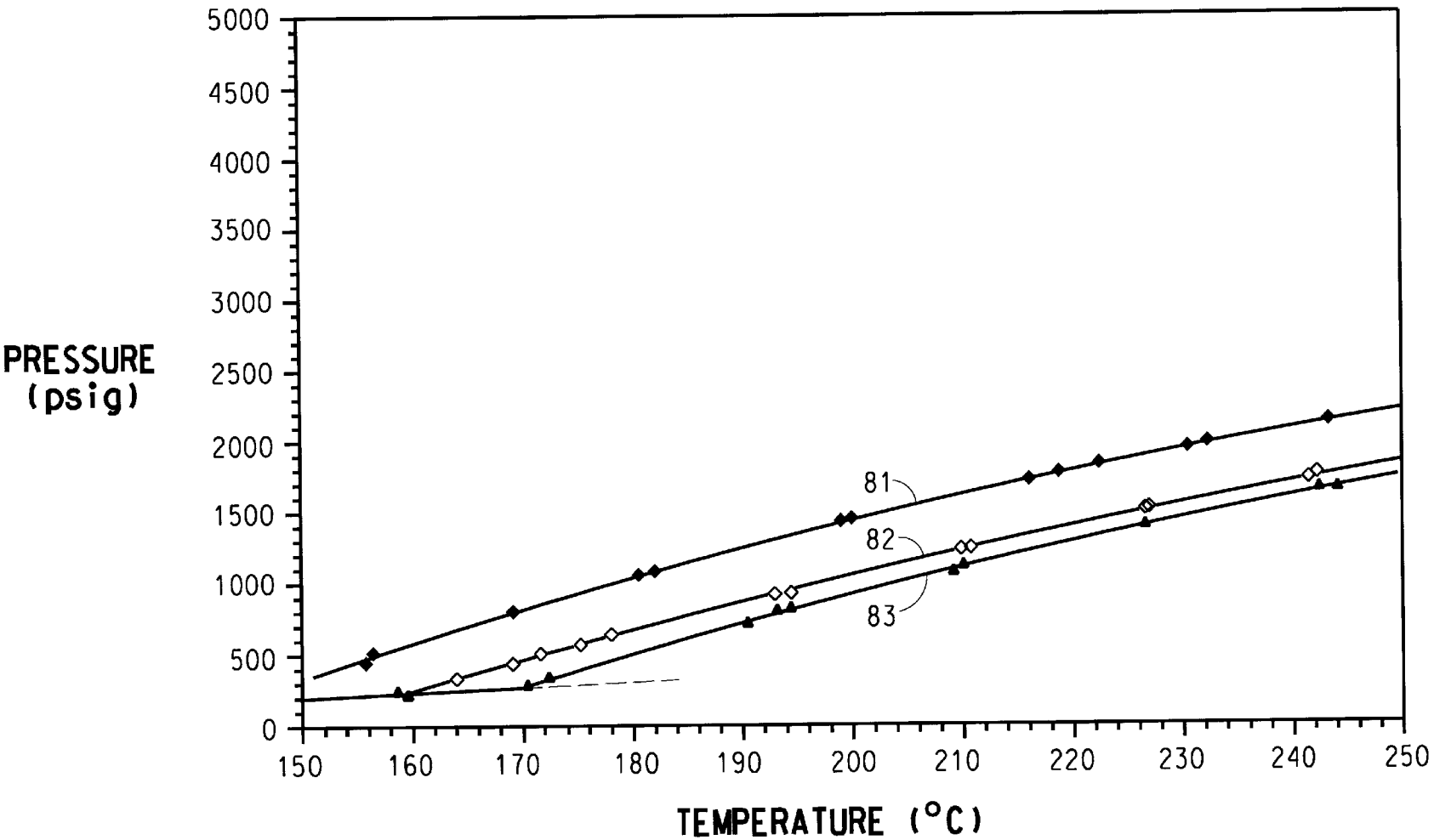
FIG. 5 is a plot of cloud point data for a 15% by weight solution of polypropylene in 100% 1-pentene and two mixtures of 1-pentene and 1-hexene.

FIG. 5 is a plot of the cloud point data for a 15% by weight solution of polypropylene in 100% 1-pentene (curve 81), and 2 mixtures of 1-pentene and 1-hexene at different solvent weight ratios (70/30, curve 82; 60/40, curve 83).

High density polyethylene is generally flash-spun at a temperature between about 170° C. and 210° C. Polypropylene can be flash-spun at temperatures between about 190° C. and 230° C. As can be seen from the cloud point plots for high density polyethylene, n-pentane and 1-pentene have similar cloud point curves based on their solvent effect for high density polyethylene. Solutions of high density polyethylene in 1-hexene have lower cloud point pressures than solutions in 1-pentene due the higher solubility of high density polyethylene in 1-hexene. When flash spinning high density polyethylene using a spin agent containing 1-hexene on existing equipment, it is preferred to mix pentane and/or pentene with 1-hexene in order to get a cloud point pressure that is in a range that is conventionally used for flash-spinning. A preferred spin agent for flash-spinning high density polyethylene comprises 30 to 70 percent by weight 1-hexene based on total spin agent with the remaining 70 to 30 percent by weight comprising n-pentane and/or 1-pentene. As used herein, the weight percents expressed for the polymers are based on the total weight of the spin fluid.

The following non-limiting examples are intended to illustrate the product and process of the invention and not to limit the invention in any manner.

EXAMPLES

The apparatus used in the Examples is the pilot flash-spinning apparatus described in published PCT Application WO 98/44176, with the addition of inverted "V-shaped" baffles as described in U.S. Pat. No. 5,123,983 to Marshall. Spin fluids were prepared by mixing the spin agent and high density polyethylene having a melt index of 0.70 g/10 min (measured according to ASTM D1238 at 190° C. and 2.16 kg load), a density of 0.958 g/cm$^3$, and a melting point of about 132° C. (Alathon®, obtained from Equistar Chemicals LP of Houston, Tex.) in a continuous mixing unit. The polyethylene contained 1000 parts per million by weight of the thermal stabilizer Fiberstab™ FS210. Fiberstab™ is a trademark of Ciba-Geigy Corporation. Polymer concentrations are reported in Table 1 below and are calculated as weight percent polymer based on the total weight of the spin fluid.

Figure 2:
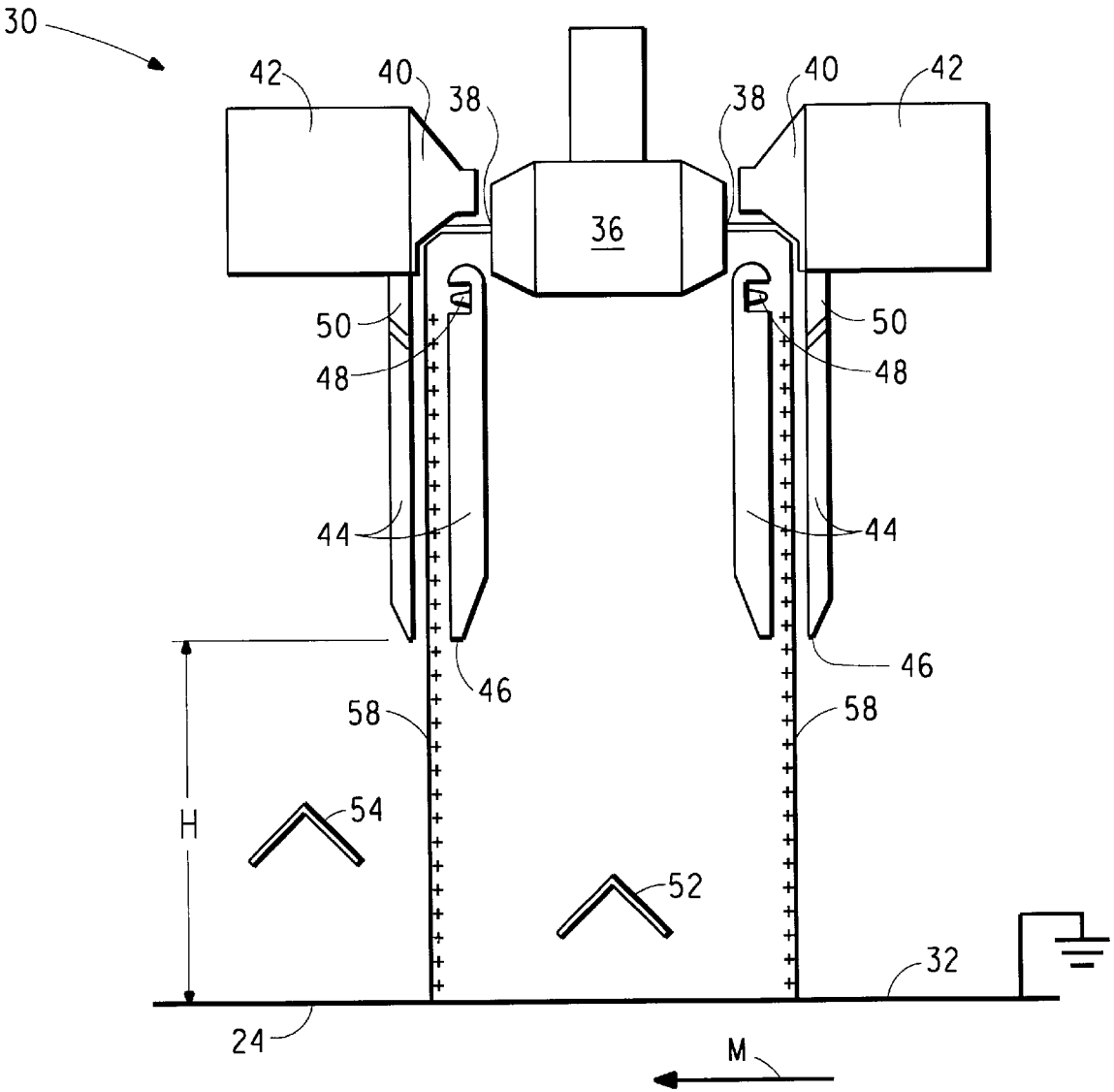
FIG. 2 is a cross-sectional schematic representation of a double-ended flash-spinning apparatus.

The spin fluids were delivered through a heated transfer line to an array of three double-ended spinneret assemblies, each having two spin orifices. FIG. 2 shows a schematic of a single double-ended spinneret assembly 30 which comprises a spinneret pack 36 having a pair of spin orifices 38 at the exit end of each of two letdown chambers. A spin tunnel 17 (as shown in FIG. 1) was located immediately downstream of each spin orifice and had the shape of a truncated cone with the diameter of the tunnel increasing away from the spin orifice. The spin orifice diameter was varied in the examples as needed in order to achieve the desired flow rate. The spin orifices direct gas and fibrous material onto internally housed rotating lobed baffles 40 driven by electric motors 42. The rotating baffles direct gas and fibrous material as a pair of laydown jets 58 downward towards collection belt 32, which is moving in direction M. The baffles cause the webs to be oscillated at about 90 Hz and a sheet having a width of about 50 cm was collected on the grounded moving bronze belt 32. The laydown jets 58 are surrounded by aerodynamic shields (diffusers) 44 in order to protect the jets before they exit from issue points 46.

Each spinneret includes a corresponding electric charging ion gun 48 and metal target plate 50. The ion gun consisted of 23 charging needles located in two rows concentric with one another (with 12 needles in the first row spaced 10° on a 7.6 cm radius, and 11 needles in the second row spaced 10° on an 8.9 cm radius). Each of the needles were connected to a common direct current power source of 100 kV variable capacity, typically set at between 5 and 20 kV. The charging polarity was negative. The tips of the charging needles were located about 1.91 cm from the target plate surface. The target plate was connected to earth ground and had a diameter of 22.9 cm. After the plexifilamentary structure was electrically charged by passing between the ion gun and target plate, the plexifilamentary structure and the transporting gaseous spin agent were passed through the diffuser 44 which had an exit gap of about 6.35 cm and a radius of about 19.69 cm. The distance "H" from the center, bottom of the diffuser 44 to the surface of moving belt 32 was 25.4 cm.

The gas management system used was similar to that described in U.S. Pat. No. 5,123,983 to Marshall, which is hereby incorporated by reference. As shown in FIG. 2, the gas management system comprised pack baffles 52 and positional baffles 54. The pack baffles 52 were located above the collection belt between the diffusers 44 of each double-ended spinneret assembly and were positioned closer to the upstream diffuser than the downstream diffuser and comprised an inverted "V-shaped" trough having a downstream leg shorter than the upstream leg. The positional baffles 54 were located halfway between adjacent double-ended spinneret assemblies and also comprised an inverted "V-shaped" trough open on each end.

The webs were consolidated after being collected on the moving belt by passing the fibrous layer between the belt and a metal consolidation roll prior to exiting the spin cell and being collected on a take-up roll as shown in FIG. 1.

Unless otherwise indicated, pressures are reported in units of psig and polymer concentrations are reported as weight percent based on the total weight of the spin fluid, where the weight of the spin fluid includes the weight of the polymer and spin agent and any additives.

Examples 1–2

Examples 1 and 2 demonstrate flash-spinning of high density polyethylene using hydrocarbon spin agents which are mixtures of unsaturated hydrocarbons 1-hexene and 1-pentene and a saturated hydrocarbon, n-pentane.

The spin agent used in Example 1 was 54% 1-hexene, 15% 1-pentene, and 31% n-pentane. The spin agent used in Example 2 was 67% 1-hexene, 28% 1-pentene, and 5% n-pentane. The percentages are weight percent based on total spin agent.

The spin fluids were prepared and flash-spun as described above. The spinneret orifices had a length of 0.025 inch (0.064 cm) and a diameter of 0.0374 inch (0.0950 cm). The spin tunnels had a diameter of 0.18 inch (0.46 cm) adjacent each spinneret orifice, expanding to an exit diameter of 0.24 inch (0.61 cm) over a distance of 0.33 inch (0.84 cm). The flow rate of the spin fluid (reported in pounds per hour of polymer per spin orifice) was varied and the uniformity index of the sheet was calculated for each flow rate. Spin conditions and uniformity data are reported in Table I and are shown graphically in FIG. 6.

Example 3

Example 3 demonstrates flash-spinning of high density polyethylene using a hydrocarbon spin agent that is a mixture of an unsaturated hydrocarbon, 1-hexene, and a saturated hydrocarbon, n-pentane. The spin agent was 60% 1-hexene and 40% n-pentane. The percentages are weight percent based on total spin agent.

The spin fluids were prepared and flash-spun as described above. The spinneret orifices had a length of 0.025 inch (0.064 cm) and a diameter of 0.0338 inch (0.0859 cm). The spin tunnels had a diameter of 0.18 inch (0.46 cm) adjacent each spinneret orifice, expanding to an exit diameter of 0.24 inch (0.61 cm) over a distance of 0.33 inch (0.84 cm). The flow rate of the spin fluid (reported in pounds per hour of polymer per spin orifice) was varied and the uniformity index of the sheet was calculated for each flow rate. Spin conditions and uniformity data are reported in Table I and are shown graphically in FIG. 6.

Example 4

Example 4 demonstrates flash-spinning of high density polyethylene using a hydrocarbon spin agent that is a mixture of an unsaturated hydrocarbons. The spin agent was 60% 1-hexene and 40% 1-pentene. The percentages are weight percent based on total spin agent.

The spin fluids were prepared and flash-spun as described above. The spinneret orifices had a length of 0.025 inch (0.064 cm) and a diameter of 0.0347 inch (0.0881 cm). The spin tunnels had a diameter of 0.18 inch (0.46 cm) adjacent each spinneret orifice, expanding to an exit diameter of 0.24 inch (0.61 cm) over a distance of 0.33 inch (0.84 cm). The flow rate of the spin fluid (reported in pounds per hour of polymer per spin orifice) was varied and the uniformity index of the sheet was calculated for each flow rate. Spin conditions and uniformity data are reported in Table I and are shown graphically if FIG. 6.

Comparative Example A

Comparative Example A demonstrates flash spinning of high density polyethylene using a paraffinic spin agent that consists of a mixture of saturated hydrocarbons.

The spin fluid was prepared using 68 wt % n-pentane and 32 wt % cyclopentane, based on total spin agent and flash-spun as described above. The spinneret orifices had a length of 0.025 inch (0.064 cm) and a diameter of 0.0366 inch (0.0930 cm). The spin tunnels had a diameter of 0.24 inch (0.61 cm) adjacent each spinneret orifice, expanding to an exit diameter of 0.28 inch (0.71 cm) over a distance of 0.33 inch (0.84 cm). The flow rate of the spin fluid (reported in pounds per hour of polymer per spin orifice) was varied and the uniformity index of the sheet was calculated for each flow rate. Spin conditions and uniformity data are reported in Table I and are shown graphically in FIG. 6.

Comparative Example B

Comparative Example B demonstrates flash spinning of high density polyethylene using a paraffinic spin agent that consists of a mixture of saturated hydrocarbons. The flow rates used in this example were lowered compared to Comparative Example A in order to better show the effect of flow rate on uniformity index using saturated hydrocarbon spin agents.

The spin fluid was prepared using 68 wt % n-pentane and 32 wt % cyclopentane, based on total spin agent and flash-spun as described above. The spinneret orifices had a length of 0.025 inch (0.064 cm) and a diameter of 0.0342 inch (0.0869 cm). The spin tunnels had a diameter of 0.18 inch (0.46 cm) adjacent each spinneret orifice, expanding to an exit diameter of 0.24 inch (0.61 cm) over a distance of 0.33 inch (0.84 cm). A smaller diameter spinneret orifice was used to achieve the reduced flow rates compared to Comparative Example A. The flow rate of the spin fluid (reported in pounds per hour of polymer per spin orifice) was varied and the uniformity index of the sheet was calculated for each flow rate. Spin conditions and uniformity data are reported in Table I below and are shown graphically in FIG. 6.

TABLE 1

| Example | Polymer Flow Rate (lb/hr/spinneret) | Polymer Concentration (wt %) | Temp. ° C. | Letdown Pressure (psig) | Uniformity Index |
|---|---|---|---|---|---|
| 1 | 57.3 | 16.9 | 180 | 1050 | 17.9 |
| | 58.9 | 16.8 | 180 | 1105 | 17.5 |
| | 60.8 | 16.8 | 188 | 1265 | 18.9 |
| | 63.3 | 18.3 | 185 | 1155 | 18.1 |
| 2 | 53.9 | 16.0 | 185 | 1045 | 17.2 |
| | 56.7 | 16.8 | 190 | 1040 | 15.8 |
| | 57.9 | 18.3 | 180 | 875 | 17.3 |
| | 59.0 | 18.5 | 180 | 930 | 17.1 |
| | 59.0 | 18.5 | 190 | 980 | 20.7 |
| | 61.0 | 18.2 | 190 | 1065 | 15.7 |
| | 69.3 | 21.9 | 180 | 750 | 17.3 |
| | 70.1 | 21.8 | 180 | 805 | 17.3 |
| | 71.5 | 21.4 | 190 | 960 | 17.9 |
| | 74.7 | 21.8 | 190 | 1015 | 19.6 |
| 3 | 51.9 | 17.5 | 180 | 965 | 17.9 |
| | 52.0 | 17.5 | 180 | 965 | 17.3 |
| | 52.3 | 18.0 | 185 | 950 | 16.2 |
| | 53.3 | 17.3 | 185 | 1095 | 20.5 |
| | 58.3 | 19.1 | 190 | 1135 | 17.9 |
| 4 | 50.4 | 17.0 | 180 | 1035 | 18.1 |
| | 51.0 | 17.2 | 180 | 1090 | 18.0 |
| | 55.7 | 18.5 | 185 | 1115 | 19.1 |
| | 56.0 | 18.2 | 185 | 1170 | 20.1 |
| A | 53.0 | 18.3 | 185 | 990 | 24.0 |
| | 53.8 | 18.1 | 190 | 1100 | 26.8 |
| | 54.2 | 17.7 | 185 | 980 | 23.8 |
| | 54.4 | 18.1 | 180 | 914 | 22.9 |
| | 55.3 | 19.7 | 180 | 840 | 26.3 |
| | 55.5 | 18.1 | 185 | 980 | 18.8 |
| | 57.6 | 21.8 | 180 | 780 | 30.4 |

TABLE 1-continued

| Example | Polymer Flow Rate (lb/hr/spinneret) | Polymer Concentration (wt %) | Temp. ° C. | Letdown Pressure (psig) | Uniformity Index |
|---|---|---|---|---|---|
| | 57.7 | 19.8 | 180 | 830 | 20.3 |
| | 57.8 | 18.1 | 190 | 1120 | 22.2 |
| | 58.5 | 20.2 | 185 | 940 | 26.7 |
| | 59.0 | 19.9 | 185 | 920 | 21.2 |
| | 59.0 | 20.1 | 180 | 830 | 19.3 |
| | 59.1 | 19.9 | 185 | 940 | 21.7 |
| | 59.1 | 20.2 | 185 | 960 | 26.3 |
| | 60.0 | 20.3 | 190 | 1040 | 26.7 |
| | 60.3 | 20.0 | 185 | 930 | 22.5 |
| | 60.3 | 19.8 | 185 | 950 | 26.0 |
| | 61.3 | 19.8 | 190 | 1050 | 22.9 |
| | 62.0 | 20.0 | 190 | 1050 | 22.7 |
| | 62.3 | 21.9 | 185 | 940 | 25.4 |
| | 62.8 | 21.9 | 190 | 995 | 27.3 |
| | 65.3 | 21.6 | 180 | 760 | 22.2 |
| | 65.7 | 21.5 | 185 | 850 | 30.8 |
| | 65.9 | 21.8 | 180 | 760 | 23.9 |
| | 66.5 | 21.8 | 185 | 845 | 20.3 |
| | 68.7 | 21.8 | 190 | 990 | 29.1 |
| B | 43.0 | 16.6 | 190 | 1035 | 18.1 |
| | 43.2 | 17.6 | 180 | 830 | 17.6 |
| | 45.0 | 17.6 | 190 | 1035 | 19.7 |
| | 47.1 | 18.9 | 185 | 885 | 21.5 |
| | 47.7 | 18.4 | 190 | 997 | 21.0 |

Figure 6:
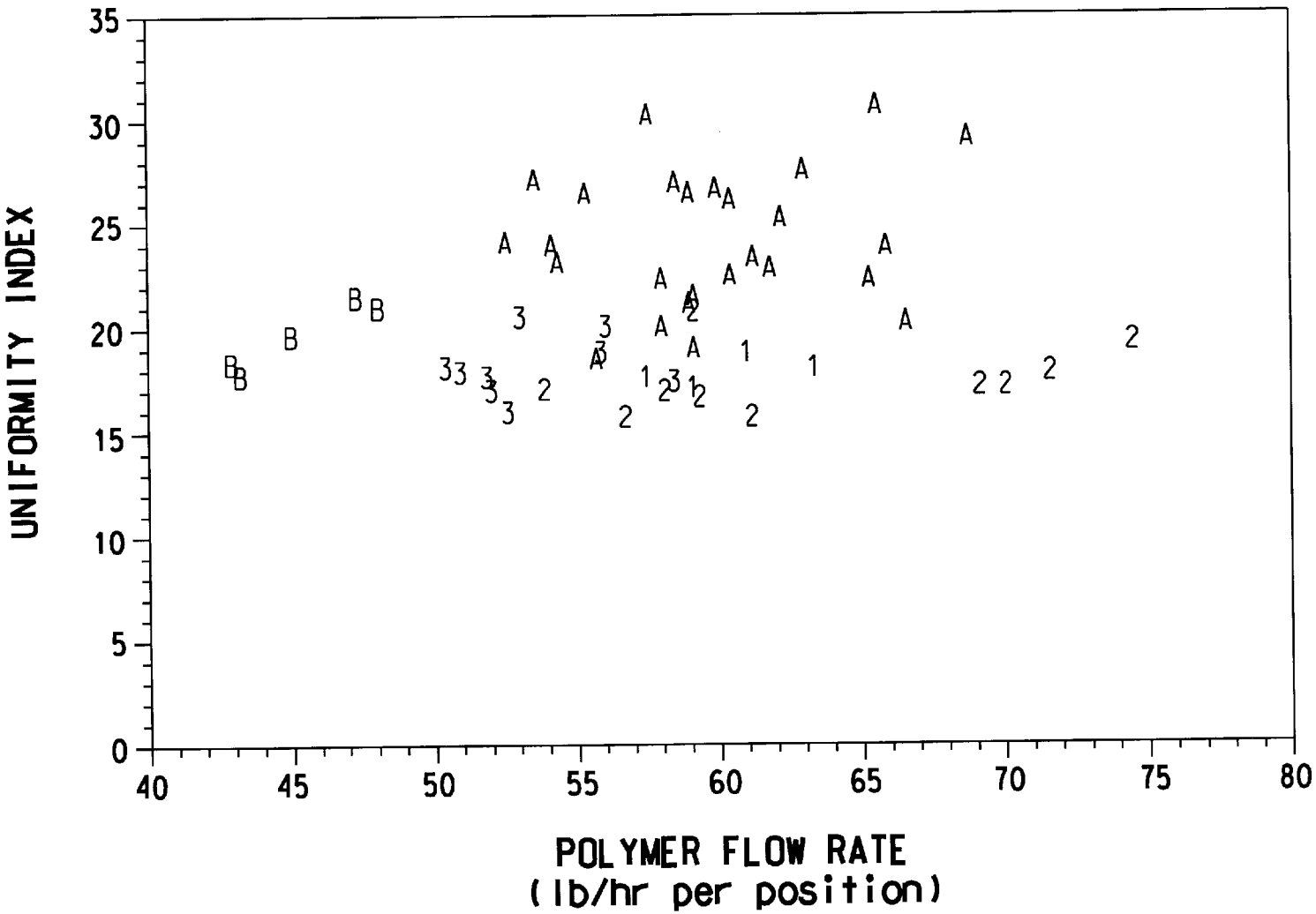
FIG. 6 is a plot of uniformity index versus polymer flow rate for sheets produced in Examples 1–4 and Comparative Examples A and B.

Referring to Table I, whose data is plotted in FIG. 6 as Uniformity Index versus polymer flow rate, it can be seen that the Uniformity Index increases with flow rate for samples made with a paraffinic spin agent (Comparative Examples A and B). In contrast, the Uniformity Index is insensitive to flow rate over the range shown for samples made with a spin agent with an olefin component.

A lower Uniformity Index indicates that a sheet is more uniform than a sheet with a higher Uniformity Index. The Uniformity Index increases as fiber pinning on the grounded belt 32 decreases. Sheets with a high Uniformity Index show a large degree of variation in mass and light transmission from point to point. Sheet with a low Uniformity Index show a low degree of variation in light transmission from point to point. The lower Uniformity Index sheets can be visually distinguished from the higher Uniformity Index sheets based on the incidence of thick and thin layering of fibers.

When a paraffinic spin agent is used, arcing between the fibers and the belt becomes significant and sheet uniformity degrades at polymer flow rates much above 50 pounds per hour per spin orifice. At high flow rate, electrical discharges (arcs) are observed as the plexifilamentary fibers 24 travel to the grounded belt 32. With the loss of charge, the fibers pin poorly and are subject to being entrained with gas turbulence, creating thick and thin areas in the sheet. These sheets, plotted in FIG. 6 as the letter "A", consistently have a uniformity index above 19.

The use of an unsaturated hydrocarbon spin agent raises the flow rate at which the arcing occurs. As a result, arcs from the fibers to the belt were not observed during spinning of the sheets made using the unsaturated hydrocarbon-containing spin agent. The pinning of the fibers to the belt was observed to be stronger, and the incidence of fibers being entrained with gas turbulence was greatly reduced. These sheets, plotted in FIG. 6 as the numbers "1", "2", and "3", consistently have a lower uniformity index than when the parraffinic were used.

It will be apparent to those skilled in the art that modifications and variations can be made in the process of this invention. Thus, it is intended that all matter contained in the foregoing description, drawings and examples shall be interpreted as illustrative and not in a limiting sense.

What is claimed is:

1. A process for flash-spinning a web of plexifilamentary film-fibril strands of synthetic fiber-forming polymer and laying down the web to form a nonwoven batt material therefrom, the process comprising the steps of:

generating a spin fluid consisting essentially of synthetic fiber-forming polymer and a spin agent, the spin agent comprised of at least 80% by weight, based on the total weight of the spin agent, of hydrocarbons comprised substantially exclusively of carbon and hydrogen atoms, said hydrocarbons comprised of at least 25% by weight of unsaturated hydrocarbons having 4–8 carbon atoms;

flash-spinning the spin fluid at a pressure that is greater than the autogenous pressure of the spin fluid into a spin cell maintained at lower pressure to form a web of plexifilamentary film-fibril strands of said synthetic fiber-forming polymer;

applying an electrostatic charge to the web; and laying the web onto a grounded surface to form a batt of plexifilamentary film-fibril strands that is suitable for being consolidated into a sheet.

2. The process of claim 1 wherein said unsaturated hydrocarbons are selected from the group consisting of alkenes having the formula $C_nH_{2n}$ and cycloalkenes having the formula $C_nH_{2n-2}$ where n equals 4, 5, 6, 7, or 8.

3. The process of claim 2 wherein n equals 5 or 6.

4. The process of claim 1 wherein said spin fluid is comprised of between 5 and 30 weight percent, based on the total weight of the spin fluid, of said fiber-forming polymer and said fiber forming polymer is a polyolefin.

5. The process of claim 4 in which the spin fluid contains 8 to 25 weight percent, based on the total weight of the spin fluid, of synthetic fiber-forming polyolefin.

6. The process of claim 4 wherein said polyolefin polymer is polyethylene.

7. The process of claim 4 wherein said polyolefin polymer is polypropylene.

8. The process of claim 2 wherein said spin agent has an atmospheric boiling point between 15° C. and 100° C.

9. The process of claim 2 wherein said unsaturated hydrocarbon is selected from the group consisting of 1-butene, 1-pentene, 1-hexene, 1-heptene, 1-octene, and their structural isomers.

10. The process of claim 2 wherein said unsaturated hydrocarbon is selected from the group consisting of cyclobutene, cyclopentene, cyclohexene, cycloheptene, and cyclooctene.

11. The process of claim 2 wherein said spin agent is comprised of at least 90% by weight of unsaturated hydrocarbons selected from the group consisting of alkenes having the formula $C_nH_{2n}$ and cycloalkenes having the formula $C_nH_{2n-2}$, where n equals 4, 5, 6, 7, or 8.

12. The process of claim 2 wherein said spin agent consists essentially of unsaturated hydrocarbons selected from the group consisting of alkenes having the formula $C_nH_{2n}$ and cycloalkenes having the formula $C_nH_{2n-2}$, where n equals 4, 5, 6, 7, or 8.

13. The process of claim 12 wherein said spin agent consists essentially of unsaturated hydrocarbons selected from the group consisting of 1-pentene, 1-hexene, and their structural isomers.

14. The process of claim 2 wherein said spin agent is comprised of at least 10% by weight of saturated hydrocarbons selected from the group consisting of alkanes having the formula $C_nH_{2n+2}$, and cycloparaffins having the formula $C_nH_{2n}$, where n=4, 5, 6, 7, or 8.

15. The process of claim 2 wherein the spin agent consists essentially of hydrocarbons comprised substantially exclusively of carbon and hydrogen atoms.

16. A process for flash-spinning a web of plexifilamentary film-fibril strands of synthetic fiber-forming polyolefin and laying down the web to form a nonwoven sheet material therefrom, the process comprising the steps of:

generating a spin fluid consisting essentially of 5 to 35 weight percent, based on the total weight of the spin fluid, of synthetic fiber-forming polyolefin and a spin agent, the spin agent comprised of at least 90% by weight, based on the total weight of the spin agent, of hydrocarbons comprised substantially exclusively of carbon and hydrogen atoms, said hydrocarbons comprised of at least 25% by weight of unsaturated hydrocarbons selected from the group consisting of alkenes having the formula $C_nH_{2n}$ and cycloalkenes having the formula $C_nH_{2n-2}$, where n equals 4, 5, 6, 7, or 8;

flash-spinning the spin fluid at a pressure that is greater than the autogenous pressure of the spin fluid into a spin cell maintained at lower pressure to form a web of plexifilamentary film-fibril strands of said synthetic fiber-forming polyolefin;

applying an electrostatic charge to the web by passing the web through an electric corona;

laying the web onto a grounded surface to form the web into a fibrous batt;

consolidating said fibrous batt to form a fibrous nonwoven sheet; and removing said fibrous nonwoven sheet from the spin cell.

17. The process of claim 16 wherein said grounded surface is a grounded conveyor belt, and wherein the step of consolidating the fibrous batt includes the step of compressing the batt between the conveyor belt and a collection roll in order to form a consolidated nonwoven sheet.

18. The process of claim 16 wherein said spin fluid is comprised of between 8 and 25 weight percent, based on the total weight of the spin fluid, of said fiber-forming polyolefin.

19. The process of claim 18 wherein said spin agent consists essentially of unsaturated hydrocarbons selected from the group consisting of 1-pentene, 1-hexene, and their structural isomers.

20. The process of claim 16 wherein said spin agent is comprised of at least 90% by weight of unsaturated hydrocarbons selected from the group consisting of alkenes having the formula $C_nH_{2n}$ and cycloalkenes having the formula $C_nH_{2n-2}$, where n equals 4, 5, 6, 7, or 8.

21. The process of claim 16 wherein the spin agent consists essentially of hydrocarbons comprised substantially exclusively of carbon and hydrogen atoms.

* * * * *